US006053543A

United States Patent [19]

Arabia, Jr. et al.

[11] Patent Number: 6,053,543

[45] Date of Patent: Apr. 25, 2000

[54] VEHICLE DOOR LATCH

[75] Inventors: Frank Joseph Arabia, Jr., Macomb Township, Macomb County; Jerry Paulik; Rita Margarete Paulik, both of Sterling Heights; Donald Michael Perkins, Rochester Hills, all of Mich.

[73] Assignee: General Motors Corporation, Detroit, Mich.

[21] Appl. No.: 09/119,677

[22] Filed: Jul. 21, 1998

[51] Int. Cl.[7] ..... E05C 3/06

[52] U.S. Cl. ..... 292/201; 292/216

[58] Field of Search ..... 292/201, 216; 70/262, 263, 150, 283

[56] References Cited

U.S. PATENT DOCUMENTS

| | | | |
|---|---|---|---|
| 3,488,075 | 1/1970 | Barnett et al. | 292/216 |
| 3,998,482 | 12/1976 | Nozaki et al. | 292/216 |
| 4,756,563 | 7/1988 | Garwood et al. | 292/216 |
| 5,277,461 | 1/1994 | Dzurko et al. | 292/216 |
| 5,328,219 | 7/1994 | Konchan et al. . | |
| 5,454,608 | 10/1995 | Dzurko et al. | 292/216 |

*Primary Examiner*—Lloyd A. Gall
*Assistant Examiner*—John B. Walsh
*Attorney, Agent, or Firm*—Kathryn A. Marra

[57] ABSTRACT

A vehicle door latch has a forkbolt, a detent that holds the forkbolt in a latched position, a release mechanism that moves the detent to release the forkbolt and a lock mechanism for disabling the release mechanism. The detent is moved by an intermittent lever that is part of the release mechanism and part of the locking mechanism. A lock lever forming part of the lock mechanism moves the intermittent lever back and forth between an unlock position where the intermittent lever drives the detent to release the forkbolt and a lock position where the intermittent lever free wheels with respect to the detent. The intermittent lever is pivotally connected to an unlatching lever of the release mechanism that is operated by inside and outside release levers. The lock lever includes a lower lock lever, an upper lock lever and a spring that stores energy when the lower lock lever pivots with respect to the upper lock lever. The lock mechanism includes an inside lock lever and an outside lock lever for operating the lower lock lever. The door latch also includes a motor driven actuator assembly for operating the lock mechanism and a double lock assembly for disabling the lock assembly so that the door latch cannot be unlocked by the inside lock lever.

20 Claims, 11 Drawing Sheets

VEHICLE DOOR LATCH

This invention relates generally to a vehicle door latch and more particularly to a vehicle door latch that has a forkbolt, a detent for holding the forkbolt in a latched position, a release mechanism for moving the detent to a position releasing the forkbolt and a lock mechanism for disabling the release mechanism.

BACKGROUND OF THE INVENTION

An automotive closure, such as a door for an automobile passenger compartment, is hinged to swing between open and closed positions and conventionally includes a door latch that is housed between inner and outer panels of the door. The door latch functions in a well known manner to latch the door when it is closed and to lock the door in the closed position or to unlock and unlatch the door so that the door can be opened manually.

The door latch is operated remotely from the exterior of the automobile by two distinct operators—typically a key cylinder that controls the lock mechanism and an outside door handle or push button that controls the release mechanism.

The door latch is also operated remotely from inside the passenger compartment by two distinct operators—a sill button that controls the lock mechanism and an inside door handle that controls the release mechanism. Vehicle door latches for upscale automobiles may also include power door locks in which the lock mechanism is motor driven and/or a keyless entry in which a key fob transmitter sends a signal to a receiver in the vehicle to operate a motor driven lock mechanism.

U.S. Pat. No. 5,277,461 granted to Thomas A. Dzurko et al Jan. 11, 1997 for a vehicle door latch, which is hereby incorporated in this patent specification by reference, discloses a typical door latch of the above noted type. The door latch disclosed in the Dzurko '461 patent includes an unlatching lever that is pivotally mounted on a stud that is secured to a metal back plate and a metal face plate at opposite ends. Unlatching lever is operated to unlatch the vehicle door by an inside handle lever that is connected by a suitable linkage for rotation by an inside door handle (not shown). Unlatching lever is also operated by an outside handle lever that is connected by suitable linkage for rotation by an outside door handle (not shown).

The Dzurko door latch also includes a locking lever that is pivotally mounted on the stud. Locking lever is operated by an inside locking lever that is pivotally mounted on the flange of the metal face plate near the inside handle lever. The inside locking lever is operated by an inside sill button or lock slide through a suitable linkage (not shown). Locking lever is also operated by an outside locking lever that is operated by a key lock cylinder through a suitable linkage (not shown). In some instances, for example in upscale automobiles, locking lever is also power operated by a remotely controlled linear electric motor or the like in a well known manner (not shown).

The door latch disclosed in the Dzurko '461 patent is unlocked and unlatched in the following sequence. First the locking lever is moved to the unlocked position by the inside locking lever, the outside locking lever, or in the instance of a vehicle equipped with power door locks, a remotely controlled motor. This moves the intermittent lever to the unlocked position. After the door latch is unlocked, the door latch is unlatched by moving the unlatching lever via inside handle lever or outside handle lever to the unlatched position pulling intermittent lever and detent down to unlatch the door lock. The vehicle door then may be pushed or pulled open manually.

U.S. Pat. No. 5,328,219 granted to Jeffrey L. Kochan et al Jul. 12, 1994 shows a vehicle closure latch of the same general type.

Door latches of the type disclosed in the Dzurko '461 patent have been used successfully by automotive manufacturers for many years.

However, there is a desire to make further improvements in the door latches of the above noted type.

SUMMARY OF THE INVENTION

The object of this invention is to provide a vehicle door latch that is compact, durable and versatile.

Another object of the invention is to provide a vehicle door latch that has a reduced number of moving parts.

A feature of the vehicle door latch of the invention is that the vehicle door latch has an intermittent lever that is incorporated in the latching mechanism and the locking mechanism in a unique way to reduce the number of moving parts.

Another feature of the vehicle door latch of the invention is that the vehicle door latch has a release mechanism and a locking mechanism that accommodate premature actuation of the release mechanism.

Yet another feature of the vehicle door latch of the invention is that the vehicle door latch has a locking mechanism that accommodates an optional double lock easily.

Still another feature of the vehicle door latch of the invention is that the vehicle door latch has a locking mechanism that accommodates an optional power lock easily.

These and other objects, features and advantages of the invention will become apparent from the description below, which is given by way of example with reference to the accompanying drawings.

BRIEF DESCRIPTION OF THE DRAWINGS

FIG. 9 is a partial rear view of the door latch of FIG. 7 showing the parts in position when the door latch is latched, locked and double locked and an unlocking operation is undertaken by an inside operator such as a sill button or the like;

FIG. 10 is a partial rear view of the door latch of FIG. 7 showing the parts in position in dashed line when the door latch is latched, locked and double locked and in solid line when an unlocking operation is initiated by an outside key cylinder or the like.

DESCRIPTION OF THE PREFERRED EMBODIMENT

Figure 1:
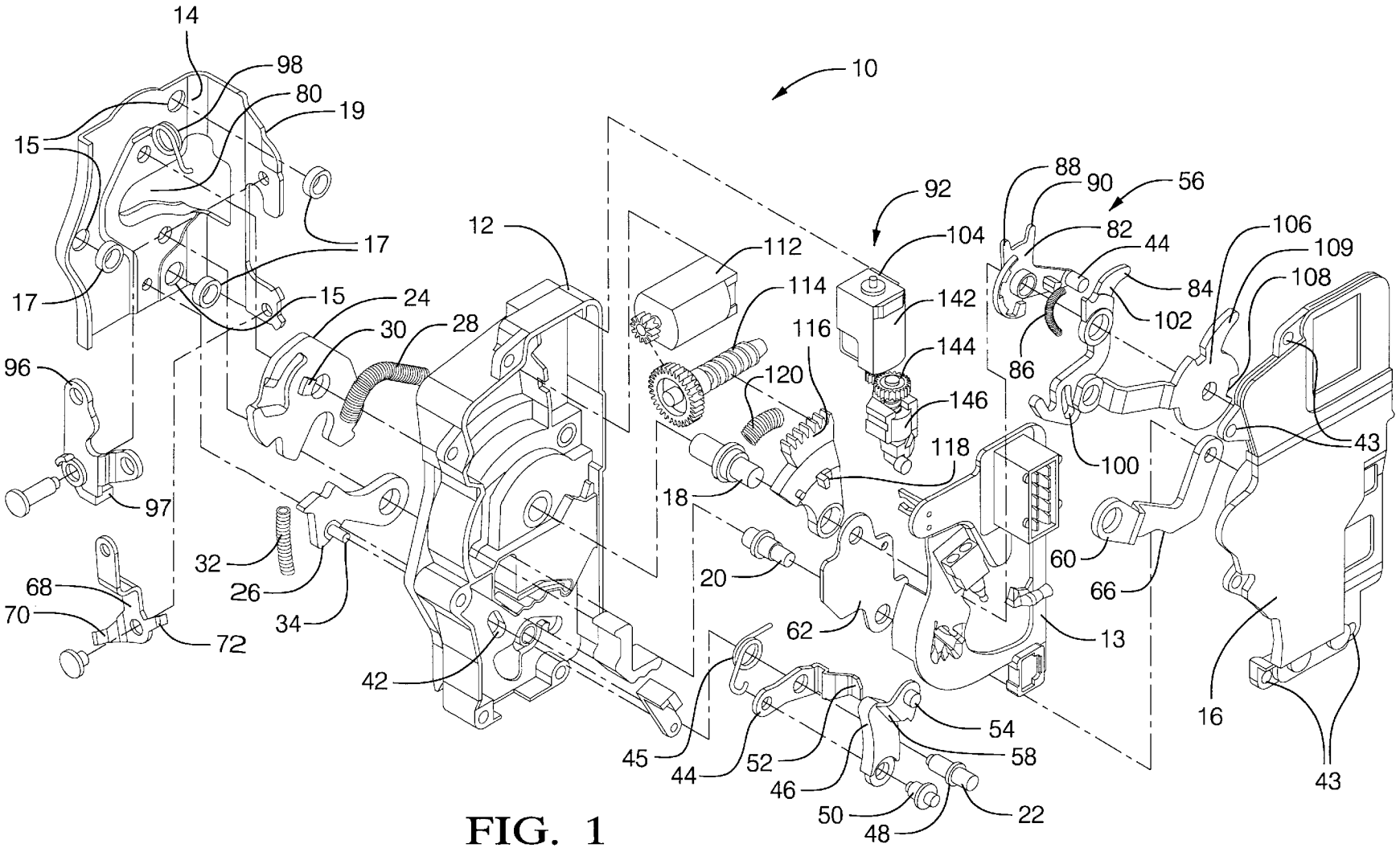
FIG. 1 is an exploded perspective rear view of a vehicle door latch in accordance with the invention.

Referring now to FIG. 1, the vehicle door latch 10 has a multipiece enclosure that comprises plastic housing 12, metal frame or face plate 14, a plastic back cover 16 and an electric control frame 13. The plastic housing 12 and the metal face plate 14 are held together by three flanged studs 18, 20 and 22 that are inserted through three holes in plastic housing 12, then through three aligned holes in the metal face plate 14 and then flanged over the metal face plate 14 to form a forward compartment. Metal face plate 14 has three holes 15 substantially equally spaced from each other defining an imaginary substantially equilateral triangle (not shown). Mounting nuts 17 are secured to face plate 14 behind holes 15 for mounting door latch 10 in a vehicle door (not shown).

Figure 2:
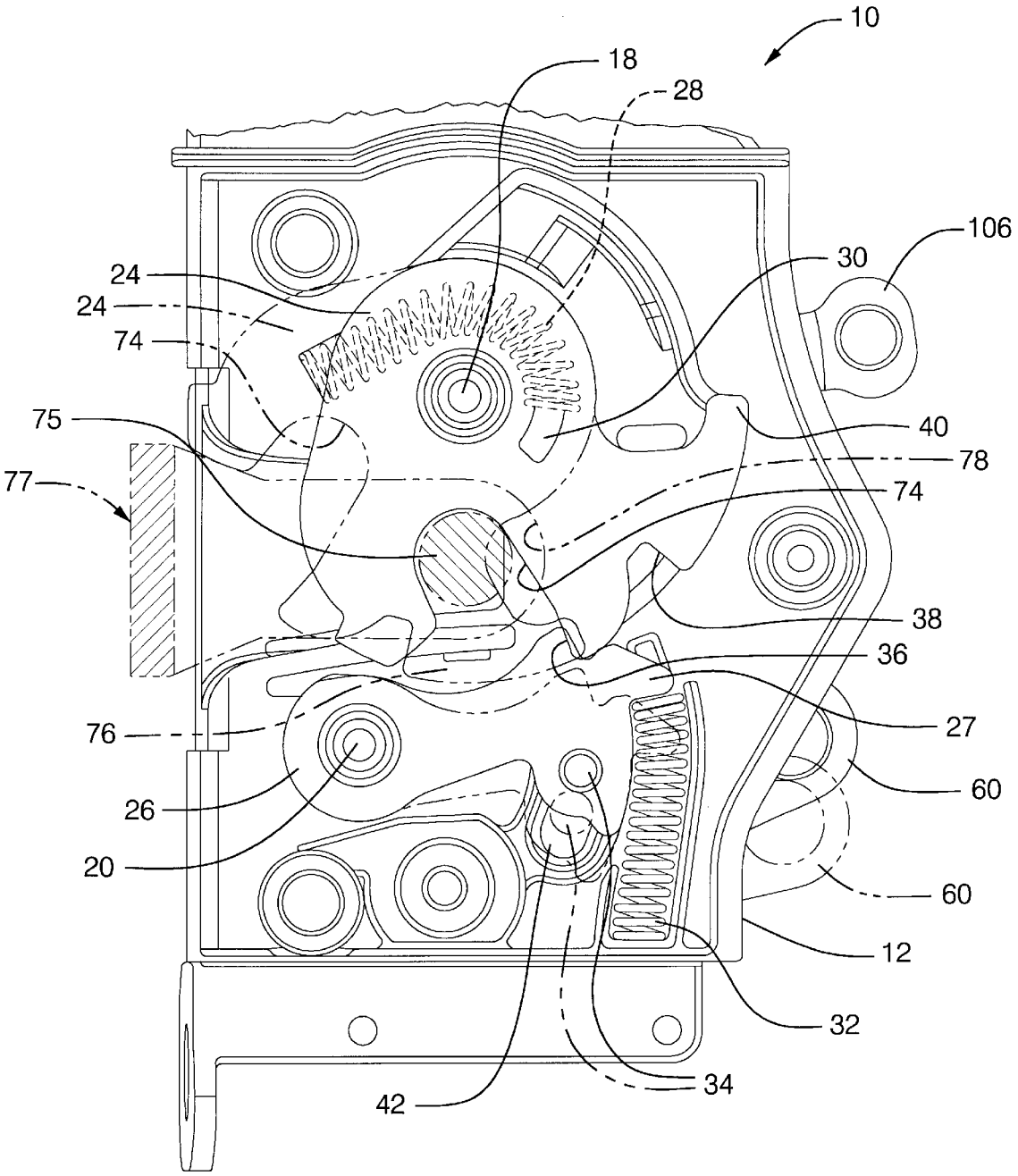
FIG. 2 is a partial front view of the door latch of FIG. 1 showing various parts of the vehicle door latch in position in solid line when the door latch is latched and unlocked and in dashed line when the door latch is unlatched and unlocked.

Door latch 10 has a latch mechanism comprising a forkbolt 24 and a cooperating detent 26 that are located in the forward compartment and pivotally mounted on the forward portions of studs 18 and 20 respectively. As best shown in FIG. 2, forkbolt 24 is biased clockwise (counterclockwise in FIG. 1) by a compression return spring 28 that is disposed in a curved slot in plastic housing 12 behind forkbolt 24. Spring 28 engages a lateral lug 30 of forkbolt 24 at one end and an end wall of the curved slot at the other end. Detent 26 is biased counterclockwise (clockwise in FIG. 1) into engagement with forkbolt 24 by a compression spring 32 that engages an ear 27 of detent 26 at one end. The opposite end of compression spring 32 engages an internal wall of housing 12.

Detent 26 engages forkbolt 24 at shoulder 36 and holds forkbolt 24 in a primary latched position against the bias of compression spring 28 as shown in solid line in FIG. 2. Detent 26 can also engage forkbolt 24 at shoulder 38 and hold it in an intermediate secondary latched position. Detent 26 engages forkbolt 24 at foot 40 in its unlatched or release position as shown in dashed line in FIG. 2. Face plate 14 is removed in FIG. 2 to facilitate illustration of internal components.

Detent 26 has a lateral pin 34 that extends through housing slot 42 into a rear compartment formed by plastic housing 12 and plastic back cover 16. Back cover 16 is attached to housing 12 by five screws (not shown) at five locations 43 along the periphery of back cover 16 with electric control frame 13 sandwiched between back cover 16 and housing 12.

Figure 3:
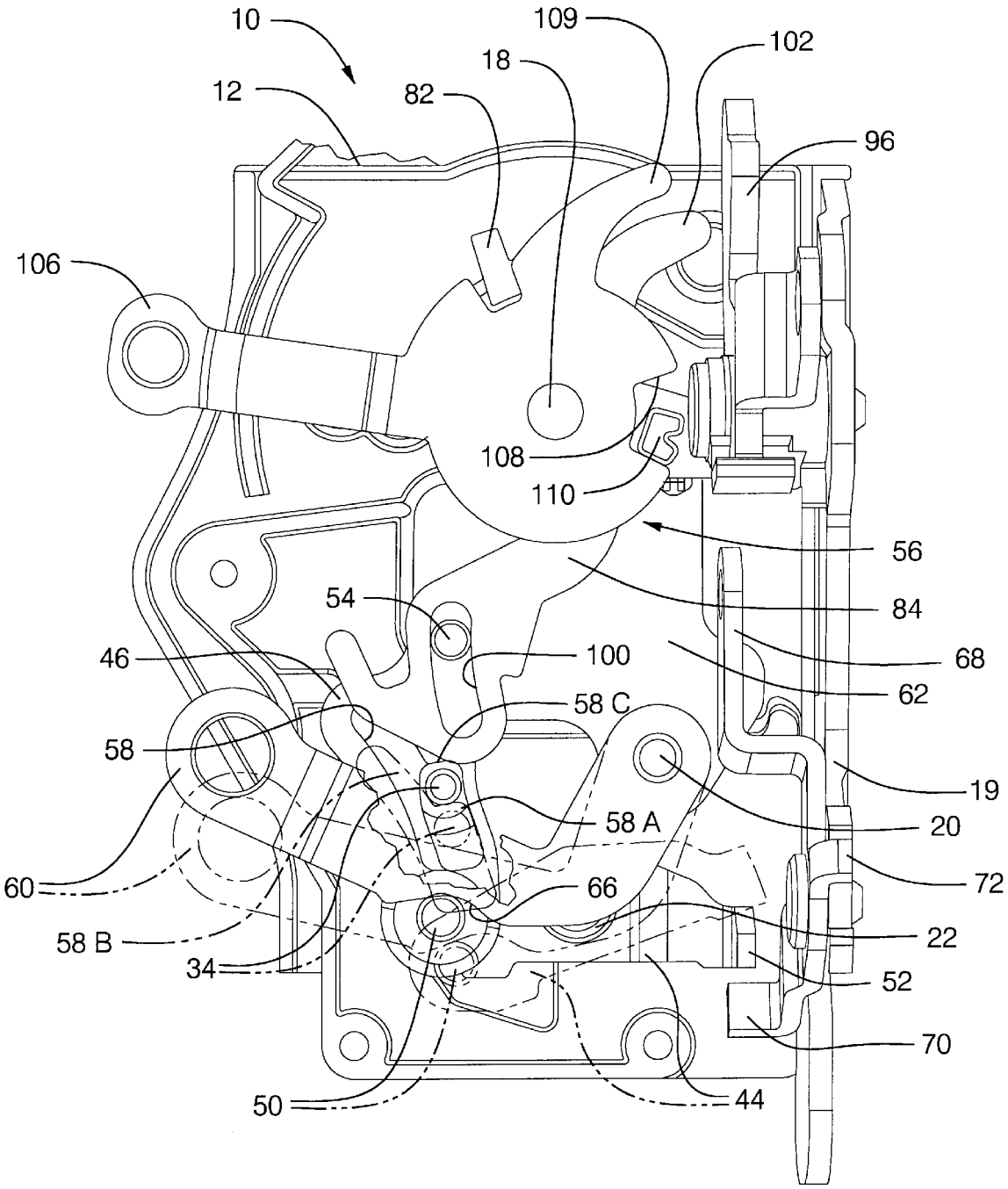
FIG. 3 is a partial rear view of the vehicle door latch of FIG. 1 showing the parts in position in solid line when the door latch is latched and unlocked and in dashed line when the door latch is unlatched and unlocked.
Figure 4:
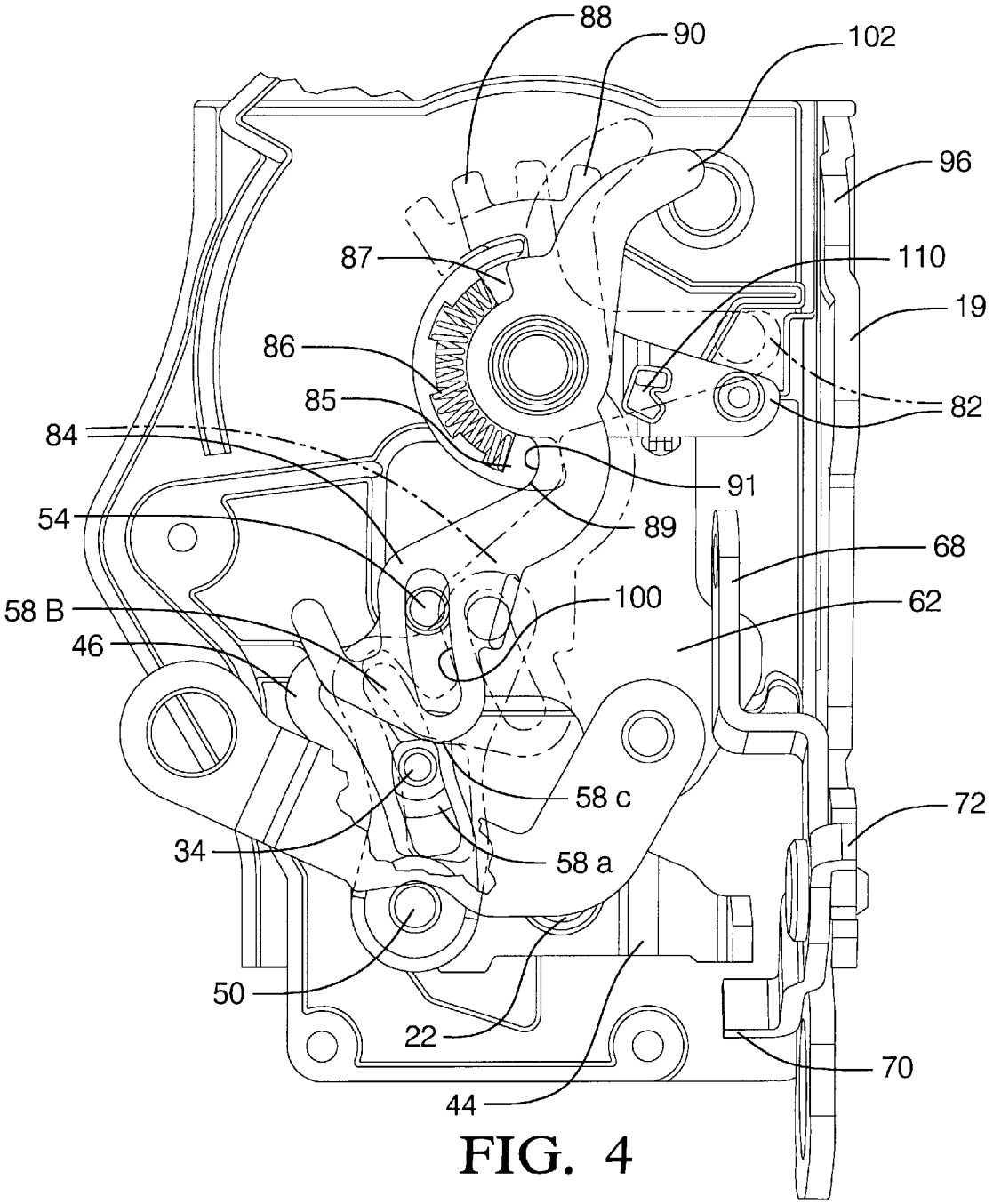
FIG. 4 is a partial rear view of the vehicle door latch of FIG. 1 showing the parts in position in solid line when the door latch is latched and unlocked and in dashed line when the door latch is latched and locked.

Door latch 10 has a release mechanism for releasing or unlatching the latching mechanism that is best shown in FIGS. 1, 3 and 4. The release mechanism comprises an unlatching lever 44 and an intermittent lever 46 for operating detent 26 that are located in the rearward compartment that is formed by plastic housing 12 and back cover 16. Unlatching lever 44 is pivotally mounted on stud 22 and held in place by flange 48. A torsion return spring 45 surrounds stud 22 between unlatching lever 44 and housing 12. One end of torsion return spring 45 is anchored to housing 12 and the other end engages unlatching lever 44 so that unlatching lever 44 is biased clockwise to a generally horizontal latching position as viewed in FIG. 1, 3 and 4. Back cover 16 is removed in FIGS. 3 and 4 to facilitate illustration of internal components. Outside release lever 60 and key cylinder lever 106 described below are also removed in FIG. 4.

The lower end of intermittent lever 46 is pivotally attached to one end of unlatching lever 44 by intermittent lever pin 50. Pin 50 has a forward pivot portion and a rearward drive portion that projects rearwardly of intermittent lever 46. The opposite end of unlatching lever 44 is bent outwardly to provide a generally perpendicular tab 52 that is used for operating unlatching lever 44. The upper end of intermittent lever 46 has a drive pin 54 that is disposed in a slot of a composite lock lever 56. Intermittent lever 46 has a forward facing groove 58 located between pins 50 and 54 that receives the end of detent pin 34 that projects through housing slot 42. Detent pin 34 engages a drive shoulder **58*c* at the upper end of a short drive portion 58*a* of groove 58 when door latch 10 is unlocked as shown in FIG. 3**.

Briefly the composite lock lever 56 which is pivotally mounted on the rearward portion of stud 18 is rotated clockwise to lock the door latch 10 or counterclockwise to unlock door latch 10. Counterclockwise rotation pivots intermittent lever 46 clockwise about lever pin 50 from an unlocked position shown in solid line in FIG. 4 to a locked position shown in dashed line in FIG. 4 where pin 34 of detent 26 is located in a lost motion portion **58*b* of groove 58 so that intermittent lever 46 does not drive detent 26 when it is pulled down. A more complete description of composite lock lever 56** and the lock mechanism is given after the release mechanism is described.

When the lock mechanism is disengaged as shown in FIG. 3, detent 26 rotates counterclockwise from the latched position shown in FIG. 1 (clockwise from the latched position shown in solid line in FIG. 2) and out of latched engagement with the forkbolt 24 to a release or unlatched position shown in dashed line in FIG. 2 when the intermittent lever 46 is pulled down. This releases forkbolt 24 so that it is free to rotate counterclockwise from the latched position shown in solid line in FIG. 2 to the unlatched position shown in dashed line under the bias of compression return spring 28 when the vehicle door is opened.

The release mechanism further comprises an outside release lever 60. One end of outside release lever 60 is pivotally mounted on stud 20 behind a support plate 62 that receives the rearward portions of studs 18 and 20 and stabilizes the studs. The opposite end of outside release lever 60 projects out of the rearward compartment formed by housing 12 and back cover 16 for connection to an outside door handle or the like via a suitable linkage (not shown). The middle portion of outside release lever 60 and a lower edge 66 engages the rearward drive portion of intermittent lever pin 50 so that outside release lever 60 pushes intermittent lever 50 down when outside release lever 60 is rotated counterclockwise as viewed in FIGS. 1 and 3.

The release mechanism further comprises an inside release lever 68 that is L-shaped. The middle of inside release lever 68 is pivotally mounted on a lower portion of a flange 19 of metal face plate 14 by a stud. Inside release lever 68 has an L-shaped arm 70 at the lower end that engages ear 52 of unlatching lever 44 so that inside release lever 68 rotates unlatching lever 44 counterclockwise when it is rotated clockwise as viewed in FIGS. 1, 3 and 4. Inside release lever 68 also has a perpendicular tab 72 at the lower end that projects into a slot in flange 19 to limit the pivotal movement of the inside release lever 68. The upper end of inside release lever 68 is connected by suitable linkage for rotation by an inside door handle or other operator (not shown).

Forkbolt 24 has a conventional slot or throat 74 for receiving and retaining a striker pin 75 of a strike assembly 77 that is attached to a vehicle door pillar (not shown) to latch the vehicle door in the closed position as shown in solid line in FIG. 2. Forkbolt 24 also includes a primary latch shoulder 36, an intermediate secondary latch shoulder 38 and a radially projecting foot 40 as indicated above. Forkbolt 24 preferably has a plastic coating that covers a surface of the slot 74 that is engaged by the strike member for energy absorption and quiet operation when the vehicle door is slammed shut.

Detent 26 has a sector shaped catch 76 that engages the radially projecting foot 40 when the forkbolt 24 is in the unlatched position shown in dashed lines in FIG. 2. The sector shaped catch 76 positively engages the primary and secondary latch shoulders 36 and 38 to hold the forkbolt 24 in either the primary latched position (FIGS. 1 and 2) or the intermediate secondary latched position (not shown).

The latch mechanism described above operates as follows. When the door latch 10 is in an unlatched and unlocked condition, forkbolt 24 is poised to receive striker pin 75 as shown in dashed lines in FIG. 2. Striker pin 75 projects into aligned fish mouth slots 78 and 80 of plastic housing 12 and metal face plate 14 when the door is shut. The entering striker pin 75 engages the back of the throat 74 and rotates forkbolt 24 counterclockwise against the bias of compression spring 28 until forkbolt 24 is rotated to the primary latch position shown in solid line in FIG. 2 where forkbolt 24 captures striker pin 75 in throat 74. Forkbolt 24 is held in the primary latch position by catch 76 of detent 26 engaging primary latch shoulder 36 of forkbolt 24.

Catch 76 rides along the periphery of the forkbolt 24 under the bias of compression spring 32 as forkbolt 24 rotates counterclockwise from the unlatched position to the primary latch position shown in FIG. 2 in dashed and solid line respectively. During this travel, catch 76 rides under the foot 40 into engagement with the intermediate secondary latch shoulder 38 and then into engagement with the primary latch shoulder 36. The engagement of catch 76 with the intermediate secondary latching shoulder 38 is sufficient to hold the vehicle door closed in the event that the vehicle door is not shut with sufficient force so that catch 76 engages primary latch shoulder 36.

The vehicle door latch 10 is now latched but not locked. Consequently the vehicle door can be opened simply by operating either an inside or outside door handle or the like to rotate inside release lever 68 or outside release lever 60 to pull intermittent lever 46 down either directly or by rotating the unlatching lever 44 counterclockwise as viewed in FIGS. 1, 3 and 4. FIG. 3 shows outside latching lever 44 rotated counterclockwise to the unlatch position shown in dashed line. This pulls pin 50 and intermittent lever 46 down. As the intermittent lever 46 is pulled down, drive shoulder 58*c* pulls detent pin 34 down and rotates detent 26 counterclockwise (clockwise in FIG. 2) against the bias of compression spring 32 from the primary latch position shown in solid line in FIG. 2 to the release or unlatch position shown in dashed lines in FIG. 2. Forkbolt 24 is then free to rotate counterclockwise (clockwise in FIG. 2) under the bias of compression spring 28 from the primary latch position shown in FIG. 1 and in solid line in FIG. 2 to an unlatched position shown in dashed line as striker pin 75 is pulled out of throat 74 and aligned fishmouth slots 78 and 80 when the vehicle door is opened.

Door Latch 10 has a lock mechanism for disabling the release mechanism that is also located in the rear compartment defined by housing 12 and back cover 16. The lock mechanism includes the composite lock lever 56 which as indicated above, rotates intermittent lever 46 clockwise to a decoupled position with respect to detent pin 34 as shown in dashed lines in FIG. 4.

Composite lock lever 56 comprises a lower lock lever 82, an upper lock lever 84 and a compression spring 86 as shown in FIG. 4.

Lower lock lever 82 is pivotally mounted on stud 18 behind support plate 62. Lower lock lever 82 has a pair of circumferentially spaced tabs 88 and 90 that cooperate with an optional power lock assembly 92 (FIG. 5) for rotating the lower lock lever between locked and unlocked positions. Lower lock lever 82 also has a drive pin 94 (FIG. 1) that is engaged by inside lock lever 96 for rotating lower lock lever 82 between the locked and unlocked positions manually. The apex of the V-shaped inside lock lever 96 is pivotally mounted on an upper part of face plate flange 19 by a stud as best shown in FIGS. 1 and 4.

An extension at the apex includes a socket that receives drive pin 94 so that inside lock lever 96 rotates lower lock lever 82 counterclockwise when it rotates clockwise and vice-versa. A laterally projecting tab 97 (FIG. 1) at the apex of inside lock lever 96 cooperates with a slot in face plate flange 19 to locate the engaged and disengaged positions of inside lock lever 96 at opposite ends of the flange slot. An overcenter spring 98 (FIG. 1) has one end attached to flange 19 and the opposite end attached to the inside lock lever 96 so that inside lock lever 96 is biased against one end or the other of the flange slot. Stated another way, inside lock lever 96 is biased to either an engaged or a disengaged position by overcenter spring 98.

The V-shaped inside lock lever 96 has a hole at the end of each leg. One or other of the holes is used for attaching inside lock lever 96 to an operator inside a vehicle, such as a sill button, via a suitable linkage (not shown). The hole that is used depends on the application of door latch 10.

Figure 5:
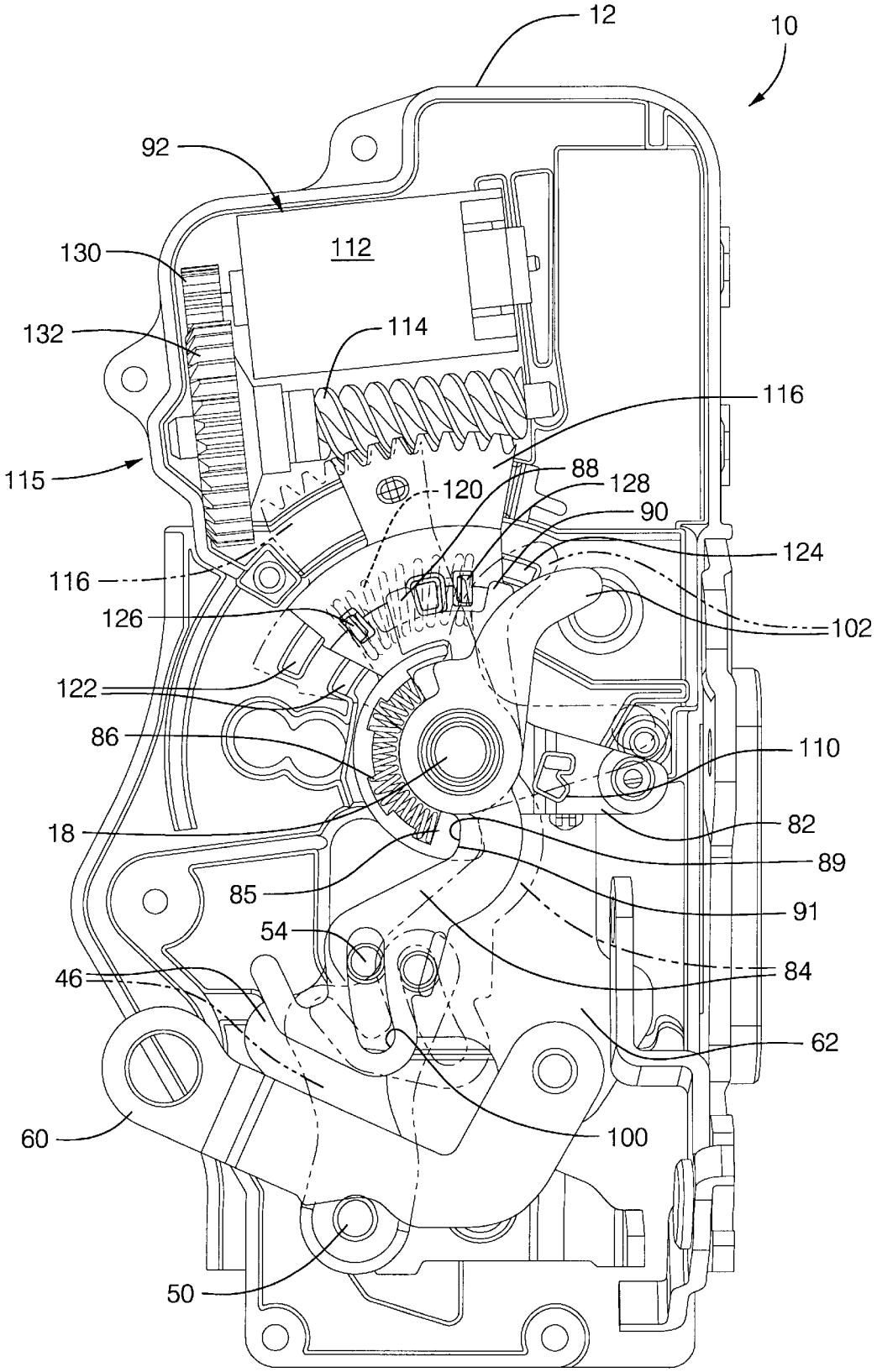
FIG. 5 is a partial rear view of the vehicle door latch of FIG. 1 equipped with an optional power lock and showing various parts in position in solid line when the door latch is latched and locked and in dashed line when the door latch is latched and unlocked.

Upper lock lever 84 is pivotally mounted on stud 18 on top of lower lock lever 82 as shown in FIG. 4. Compression spring 86 is disposed between lower and upper lock levers 82 and 84 and contained in a curved slot formed by portions of lower lock lever 82 and upper lock lever 84. One end of compression spring 86 engages a stop 85 of lower lock lever 82 and the other end of spring 86 engages a stop 87 of upper lock lever 84 so that upper lock lever 84 is biased clockwise with respect to lower lock lever 82 as best shown in FIGS. 4 and 5.

Upper lock lever 84 has a slot 100 at the lower end and an ear 102 at the upper end. Slot 100 receives drive pin 54 of intermittent lever 46. Ear 102 cooperates with an optional double lock assembly 104 as explained below.

An optional key cylinder lever 106 is pivotally mounted on stud 18 on top of upper lock lever 84 as shown in FIGS. 1 and 3. Key cylinder lever 106 has been omitted in FIGS.

4 and 5 for clarity. Key cylinder lever 106 has a drive slot 108 at one end that receives a drive lug 110 of lower lock lever 82 so that lower lock lever 82 is rotated by outside lock lever 106. Drive slot 108 is wider than drive lug 110 to permit independent operation of inside lock lever 96. Key cylinder lever 106 has a radial ear 109 near the socket end that also cooperates with the optional double lock assembly 104 as explained below. The opposite end of key cylinder lever 106 has a hole for attaching the key cylinder lever to a key lock cylinder or the like by a suitable linkage (not shown). Key cylinder lever 106 is used in any application having a key lock cylinder or the like, such as front doors of vehicles. However, key cylinder lever 106 may be omitted in any application that does not have a key lock cylinder or other operator for unlocking a vehicle door from the exterior, such as rear doors of passenger vehicles.

Door latch 10 is locked in the following manner. Lower lock lever 82 is rotated counterclockwise from the unlocked position shown in FIGS. 1, 3 and 4 to the locked position shown in dashed lines in FIG. 4 by rotating either key cylinder lever 106 counterclockwise or inside lock lever 96 clockwise. Lower lock lever 82 drives upper lock lever 84 counterclockwise to the locked position via abutting portions 89 and 91. As upper lock lever 84 rotates counterclockwise, slot 100 engaging drive pin 54 rotates intermittent lever 46 clockwise from the unlocked position shown in solid line FIG. 4 to a locked position shown in dashed line where drive pin 34 of detent 26 located in a lost motion portion 58*b* of groove 58. Consequently when intermittent lever 46 is pulled down by unlatching lever 44 or outside release lever 60 in an unlatching operation, motion is not transferred to detent pin 34. Detent 34, therefore, stays engaged with forkbolt 24 and the door latch 10 remains latched.

Door latch 10 is unlocked by rotating the lower lock lever 82 clockwise back to the unlocked position shown in solid line in FIG. 4. Lower lock lever 82 rotates upper lock lever 84 clockwise more or less simultaneously back to the unlocked position shown in solid line in FIG. 4 via compression spring 86. As upper lock lever 84 rotates clockwise, slot 100 drives intermittent lever 46 counterclockwise back to the unlocked position via pin 54.

Composite lock lever 56 may be replaced by a simpler lock lever of unitary construction (not shown) in a basic vehicle door latch. However, the composite lock lever 56 is preferred because the composite lock lever 56 provides an anti-jamming feature that allows premature actuation of inside release lever 68 or outside release lever 60 and a subsequent unlocking operation while either inside release lever 68 or outside release lever 60 is held in a release or unlatching position.

This antijamming feature operates as follows. When door latch 10 is locked as shown in dashed line in FIG. 4, detent pin 34 is positioned in the elongated position 58*b* of intermittent lever slot 58. When door latch 10 is locked and either inside release lever 68 or outside release lever 60 is actuated, intermittent lever 46 is pulled down so that detent pin 34 is repositioned in the upper portion of elongated slot portion 58*b* above drive shoulder 58*c*. If a one-piece lock lever is used in place of composite lock lever 56, the one-piece lock lever cannot be pivoted clockwise back to the unlocked position if either release lever 60 or 68 is actuated and held in an unlatching or release position because intermittent lever 46 is held against rotation by detent pin 34 and cannot pivot counterclockwise. However, when composite lock lever 56 is used, only upper lock lever 84 is held against rotation by detent pin 34. Thus, an unlocking operation of inside lock lever 96 or key cylinder lever 106 still rotates lower lock lever 82 clockwise back to the unlocked position shown in solid line in FIG. 4. This loads lock lever spring 86 and "cocks" composite lock lever 56 so that upper lock lever 84 pivots clockwise to the unlocked position shown in solid line in FIG. 4 under the action of lock lever spring 86 when the prematurely actuated release lever 60 or 68 is returned to the latch position allowing unlatching lever 44 and coild spring 45 to raise intermittent lever 46. When intermittent lever 46 rises up, detent pin 34 is free to enter slot portion 58*a* below drive shoulder 58*c*. Hence intermittent lever 46 is simultaneously pivoted counterclockwise to the unlocked position shown in solid line in FIG. 4 under the action of lock lever spring 86 due to the presence of drive pin 54 in slot 100.

Door latch 10 is now unlocked and can now be unlatched by a second unlatching operation by either inside release lever 68 or outside release lever 60.

The anti-jamming feature provided by composite lock lever 56 is particularly advantageous when a power lock assembly, such as the optional power lock assembly 92 described below is used because jamming is more likely to occur in a power unlocking operation rather than in a manual unlocking operation.

The composite lock lever 56 is also preferred because the optional double lock feature described below can be provided easily without any need for changing the lock lever.

Figure 6:
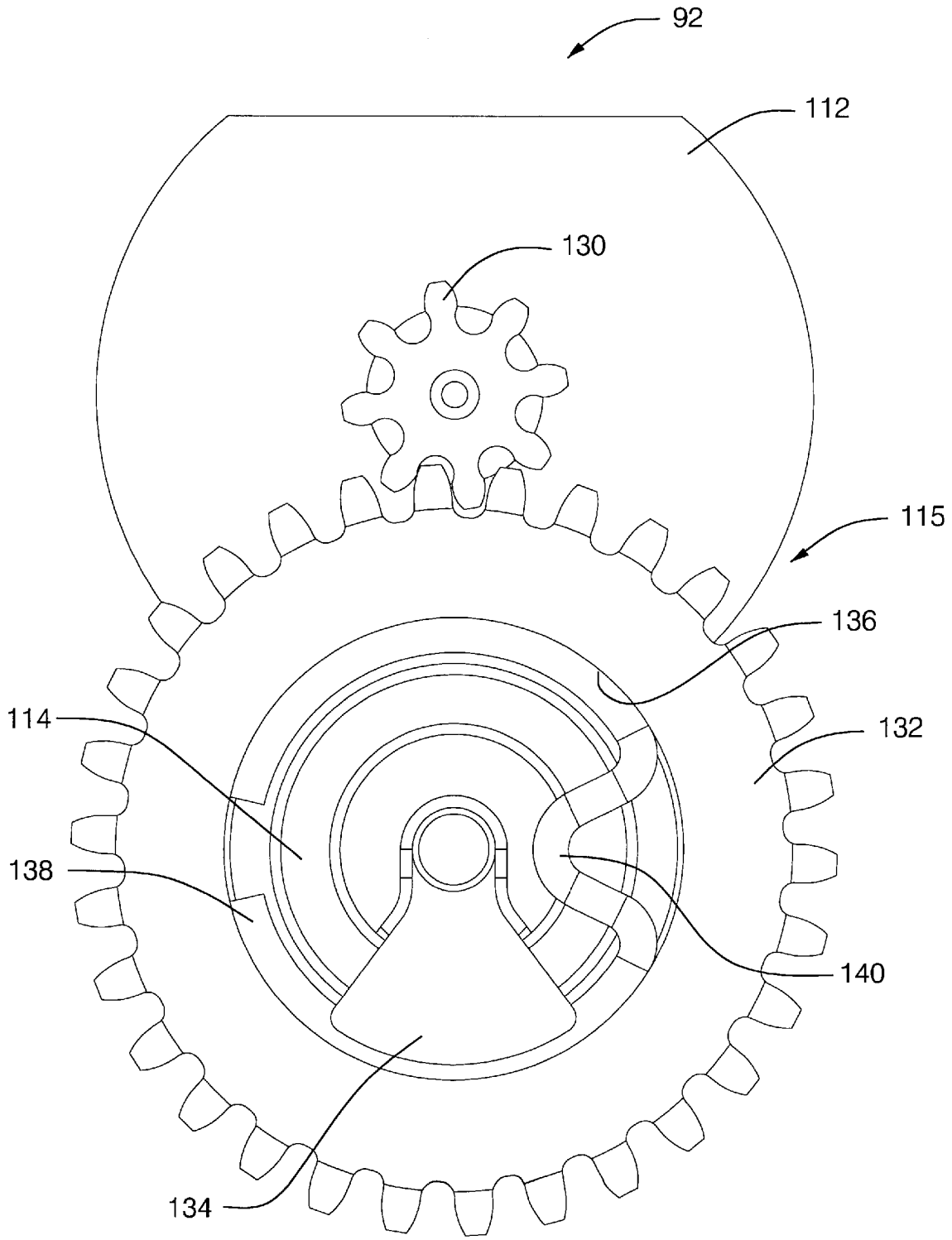
FIG. 6 is a section view taken substantially along the line 6—6 of FIG. 5 looking in the direction of the arrows.

As indicated above, door latch 10 may also be locked and unlocked by the optional power actuator assembly 92 shown in FIGS. 5 and 6. Power actuator assembly 92 comprises a reversible electric actuator motor 112 that drives an actuator worm gear 114 through a reduction gear set and slip clutch arrangement 115. Worm gear 114 drives an integral sector gear at the upper end of an actuator lever 116. Actuator lever 116 is pivoted on stud 18 and located between housing 12 and back plate 62 beneath lower lock lever 82. Actuator lever 116 includes a drive lug 118 that is disposed between tabs 88 and 90 of lower lock lever 82 for driving lower lock lever 82 between the locked and unlocked positions.

Power actuator assembly 92 further includes a centering device that biases actuator lever 116 and drive lug 118 to a neutral position with respect to housing 12. The centering device comprises compression spring 120 that is located between the back of housing 12 and the upper end of actuator lever 116. The back of housing 12 has two pairs of radially spaced stops 122 and 124 that are circumferentially spaced from each other. The front of actuator lever 116 has two circumferentially spaced stops 126 and 128 that fit between the respective pairs of radially spaced stops 122 and 124. One end of compression spring 120 engages radially spaced stops 122 and stop 126. The opposite end of compression spring 120 engages radially spaced stops 124 and stop 128. Thus whenever actuator lever 116 pivots on stud 18 relative to housing 12 compression spring 120 biases actuator lever back to the neutral position shown in solid line in FIG. 5.

As indicated above, power actuator assembly 92 also includes pinion gear 130 and spur gear 132 of a reduction gear set that drive connects electric motor 112 to worm gear 116 and a slip clutch arrangement 115. Slip clutch arrangement 115 is achieved by mounting spur gear 132 rotatably on a cylindrical end of worm gear 114 the end face of which has an axially protruding lug 134 as best shown in FIG. 6. Spur gear 132 has a counter bore 136 that holds a C-shaped spring 138 that biases itself against the cylindrical surface of counterbore 136. Spring 138 has a V-shaped radial portion 140 that extends radially inward midway between the ends of the C-shaped spring. Spur gear 132 drives worm gear 114 via spring portion 140 and lug 134.

Door latch 10 is locked by power actuator assembly 92 in the following manner.

A control switch is actuated that energizes electric motor 112 through a motor control circuit to drive pinion gear 130 clockwise for a predetermined amount of time. The control switch can be manually operated or automatically operated responsive to vehicular drive or both. Such control switches and motor control circuits are well known in the art and need not be described in detail.

Suffice it to state that electric motor 92 is energized via electric control frame 13 to drive pinion gear 130 clockwise for a short period of time. Pinion gear 130 drives spur gear 132 counterclockwise in a speed reducing, torque multiplying relationship. Pinion gear 130 rotates load free initially permitting electric motor 112 to develop torque. After about a ¾ turn, radial portion 140 of spring 138 engages drive lug 134 so that spur gear 132 drives worm gear 114 counterclockwise as viewed in FIG. 6. Worm gear 114 drives actuator lever 116 counterclockwise from the neutral position shown in solid line in FIG. 5 to the locked position shown in dashed line.

Actuator lever 116 drives lower lock lever 82 counterclockwise from the unlocked position shown in solid line to the locked position shown in dashed line via drive lug 118 and tab 88. Lower lock lever 82 drives upper lock lever 84 counterclockwise to the locked position shown in dashed line via engaging portions 89 and 91. Upper lock lever 84 drives intermittent lever 46 clockwise to the locked position shown in dashed line via pin 54 and slot 100. If electric motor 112 is still energized after the actuator lever 116, lock levers 82 and 84 and intermittent lever 46 reach the locked position, slip spring 138 (FIG. 6) slips in counterbore 136 responsive to a predetermined torque level to protect electric motor 112 from overload.

When electric motor 112 stops, centering spring 120 returns actuator lever 116 to the neutral position shown in solid line in FIG. 5 back driving worm gear 114 and backing lug 134 away from the radial portion 140 of slip spring 138 (FIG. 6). Lug 118 now engages tab 90 and the door latch 10 is in condition for a power unlocking operation as shown in FIG. 5.

Briefly power unlocking is accomplished by energizing electric motor 112 in a reverse direction to drive pinion gear 130 counterclockwise. This drives spur gear 132 and worm gear 114 clockwise as viewed in FIG. 6 and drives actuator lever clockwise from the neutral position shown in solid line in FIG. 5 to an unlock position (not shown). Lower lock lever 82 is now driven clockwise from the lock position shown in dashed line back to the unlock position shown in solid line. Lower lock lever 82 drives upper lock lever 84 clockwise to the unlock position shown in solid line via spring 86 and upper lock lever 84 drives intermittent lever 46 counterclockwise to the unlocked position shown in solid line via pin 54 and slot 100. When unlocking is completed; centering spring 120 returns actuator lever 116 to the neutral position shown in solid line where drive lug 118 engages tab 88 for a locking operation.

Door latch 10 may be locked and unlocked manually without effecting the power lock assembly 92 because of the wide gap between tabs 88 and 90. The wide gap allows manipulation of lower lock lever 82 between locked and unlocked positions without imparting any movement to actuator lever 116. In fact, the gap is wider than lug 118 by a predetermined amount so that manual unlocking positions drive lug 118 against tab 88 for a subsequent power locking operation while manual locking positions drive lug 118 against tab 90 for a subsequent power unlocking operation.

As indicated above, the power lock assembly 92 can be used in a door latch having a lock lever of unitary construction. However, the composite lock lever 56 provides an anti-jamming feature that is particularly advantageous in a door latch that has a power operated locking mechanism.

As indicated above, door latch 10 may also include the optional double lock assembly 104 that is shown in FIGS. 1 and 7–10. Double lock assembly 104 comprises a reversible electric motor 142 that drives a screw 144 via a reduction gear set. Screw 144 is threaded into a lock block 146. These parts are part of a subassembly that includes a cradle 148 that is secured in a upper chamber in the rear compartment formed by housing 12 and back cover 16 which has been removed for clarity. Screw 144 extends down vertically into lock block 146 which has a flat surface that engages a flat surface of cradle 148 so that lock block 146 slides up or down responsive to the direction of rotation of screw 144. Lock block 146 has a vertical stop wall 150 and a contiguous ramp wall 151 that extend rearwardly. Lock block 146 also has a drive pin 152 below stop wall 150 and ramp wall 151 that extends rearwardly beyond walls 150 and 151. Walls 150 and 151 cooperate with ear 102 of upper lock lever 84 and drive pin 152 cooperates with ear 109 (FIGS. 1, 3 and 10) of key cylinder lever 106.

Figure 7:
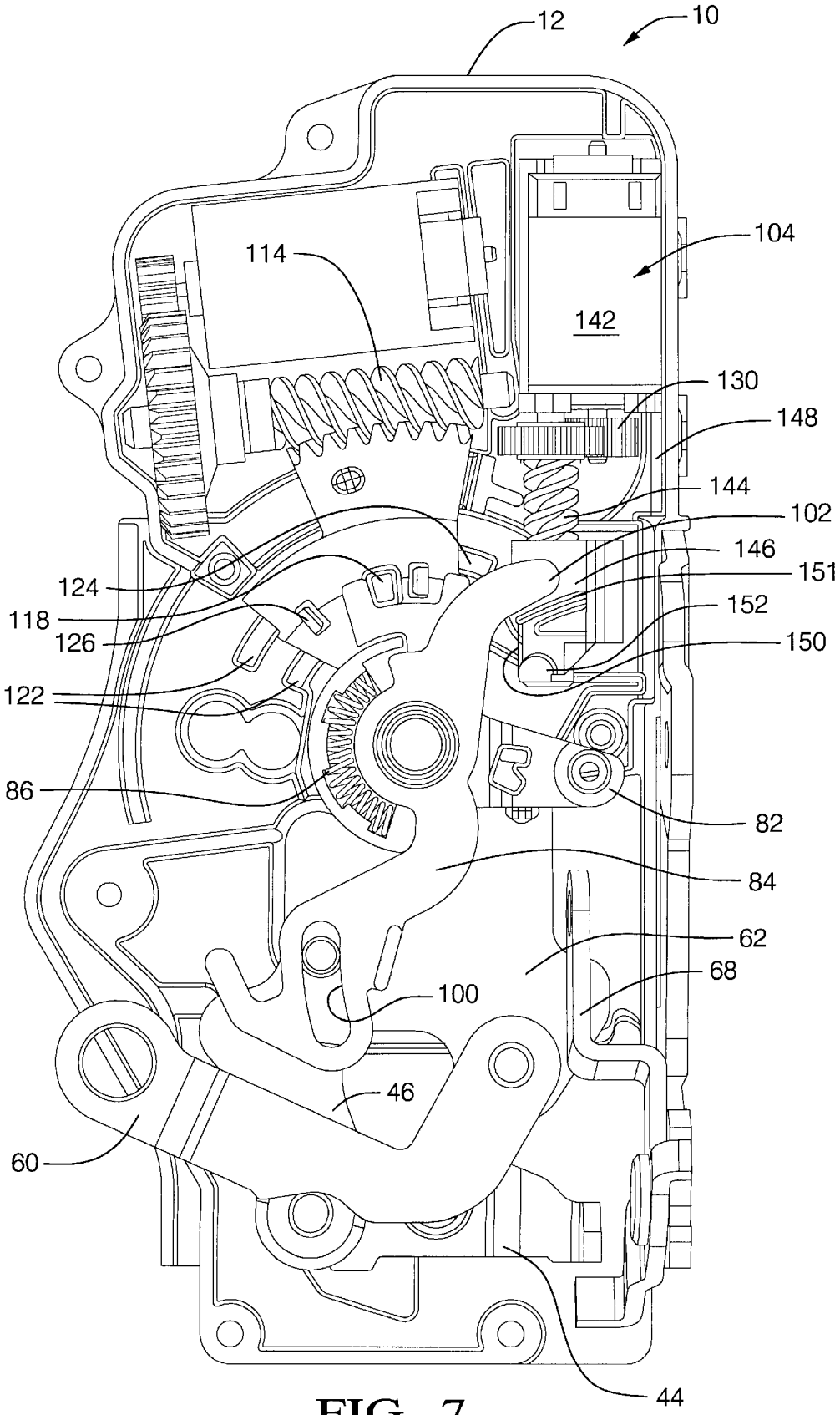
FIG. 7 is a partial rear view of the vehicle door latch of FIG. 1 equipped with an optional power lock and an optional double lock and showing various parts in position when the door latch is latched and unlocked with the double lock disengaged.
Figure 8:
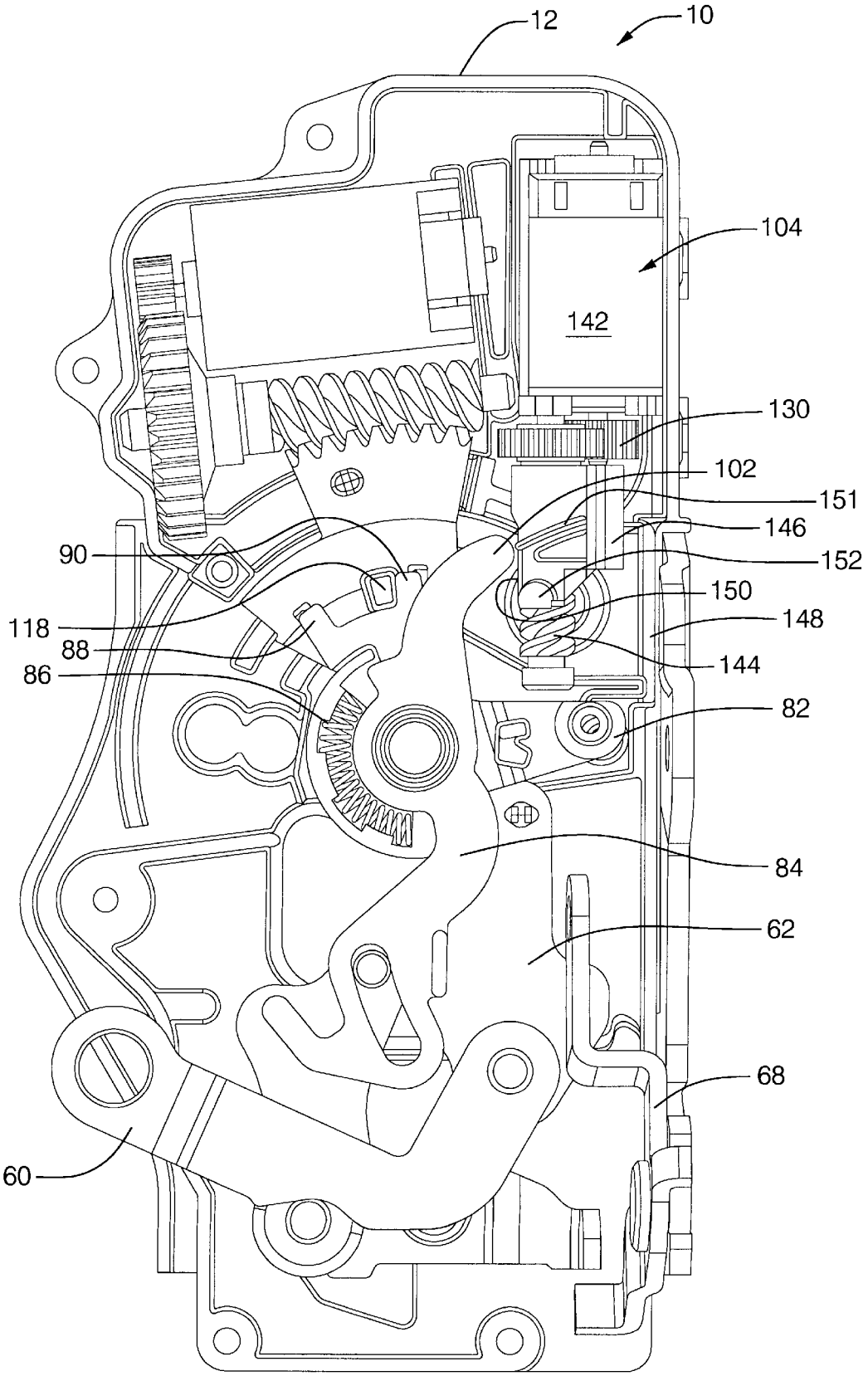
FIG. 8 is a partial rear view of the door latch of FIG. 7 showing the parts in position when the door latch is latched, locked and double locked.

Door latch 10 is double locked as follows. First door latch 10 is locked as described above which rotates both lower and upper lock levers 82 and 84 counterclockwise to the locked position shown in dashed lines in FIG. 4. This moves ear 102 of upper lock lever 84 out from its unlocked position above walls 150 and 151 of lock block 146 as shown in FIG. 7 to its locked position to the left of stop wall 150 as shown in FIG. 8. Motor 142 which is usually controlled by a key lock cylinder or a key fob is then energized via electric control frame 13 to raise lock block 146 from the disengaged position shown in FIG. 7 to an engaged position shown in FIG. 8 where stop wall 150 of lock block 146 blocks ear 102 preventing upper lock lever 84 from rotating clockwise from the locked position shown in FIG. 8 back to the unlocked position shown in FIG. 7. When lock block 146 reaches the engaged position shown in FIG. 8, motor 142 stalls and deenergizes. Control switches and motor control circuits are well known in the art and need not be described in detail as any suitable arrangement may be used.

Figure 9:
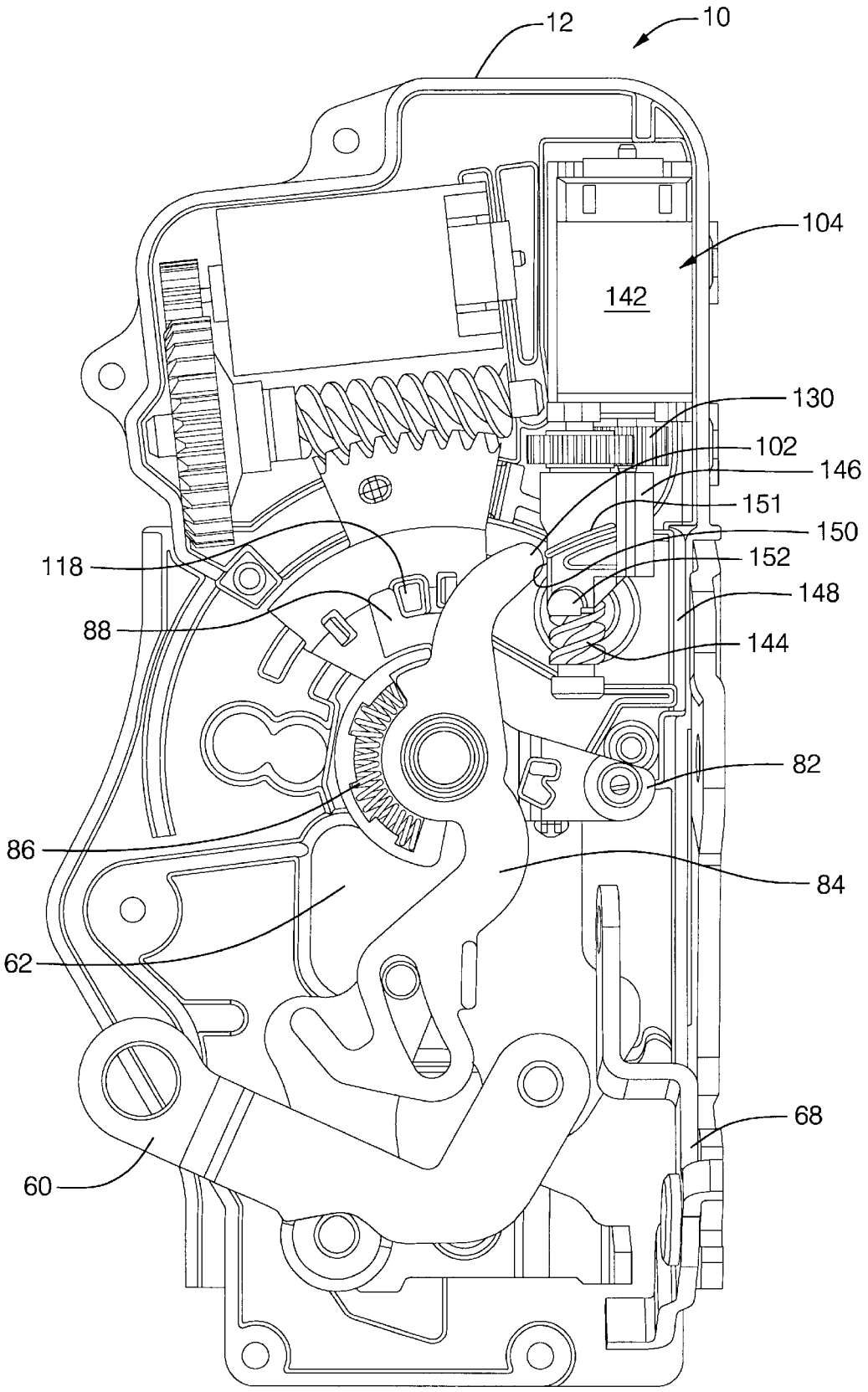

When the double lock is engaged, door latch 10 cannot be unlocked by inside lock lever 96 because clockwise rotation of inside lock lever 96 to the unlocked position merely rotates lower lock lever 82 clockwise back to the unlocked position as shown in FIG. 9. However, upper lock lever 84 being blocked by lock block 146 stays in the locked position with the clockwise rotation of lower lock lever 82 storing energy in compression spring 86 for subsequent disengagement of the double lock as shown in FIG. 9.

The optional double lock assembly 104 prevents unauthorized persons from entering a double locked vehicle by using the sill button or other inside lock operator to unlock the vehicle door and then unlatching the door using the outside door handle.

The double lock can be disengaged in two ways. One way is to reverse electric motor 142 so that lock block 146 is lowered from the engaged position shown in FIGS. 8 and 9 back to the disengaged position shown in FIG. 7. This unblocks ear 102 and allows upper lock lever 94 to rotate clockwise back to the unlocked position shown in FIG. 7 under the action of compression spring 86 when door latch 10 is unlocked. In this regard it should be noted that the unlocking operation can be undertaken before or after double lock 104 is disengaged. If the unlocking operation is undertaken before double lock 104 is disengaged, lower lock lever 82 is moved to the unlocked position cocking the lock mechanism. Upper lock lever 84 and the rest of the locking mechanism is then moved to the unlocked position by spring 86 when double lock 104 is disengaged.

If double lock 104 is disengaged first, the unlocking operation proceeds in a conventional manner as in the case of a door latch that is not equipped with a double lock.

Figure 10:
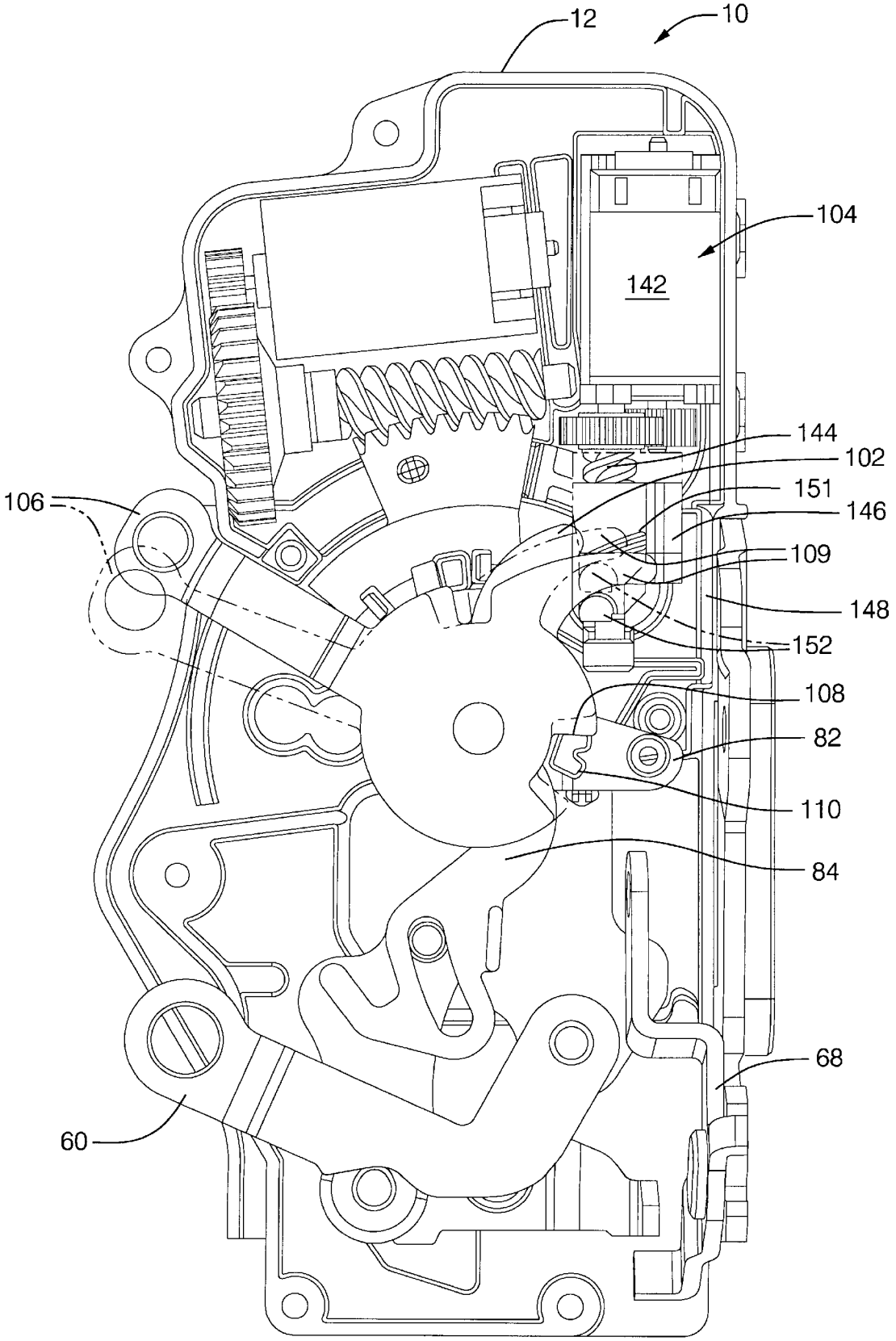
Figure 11:
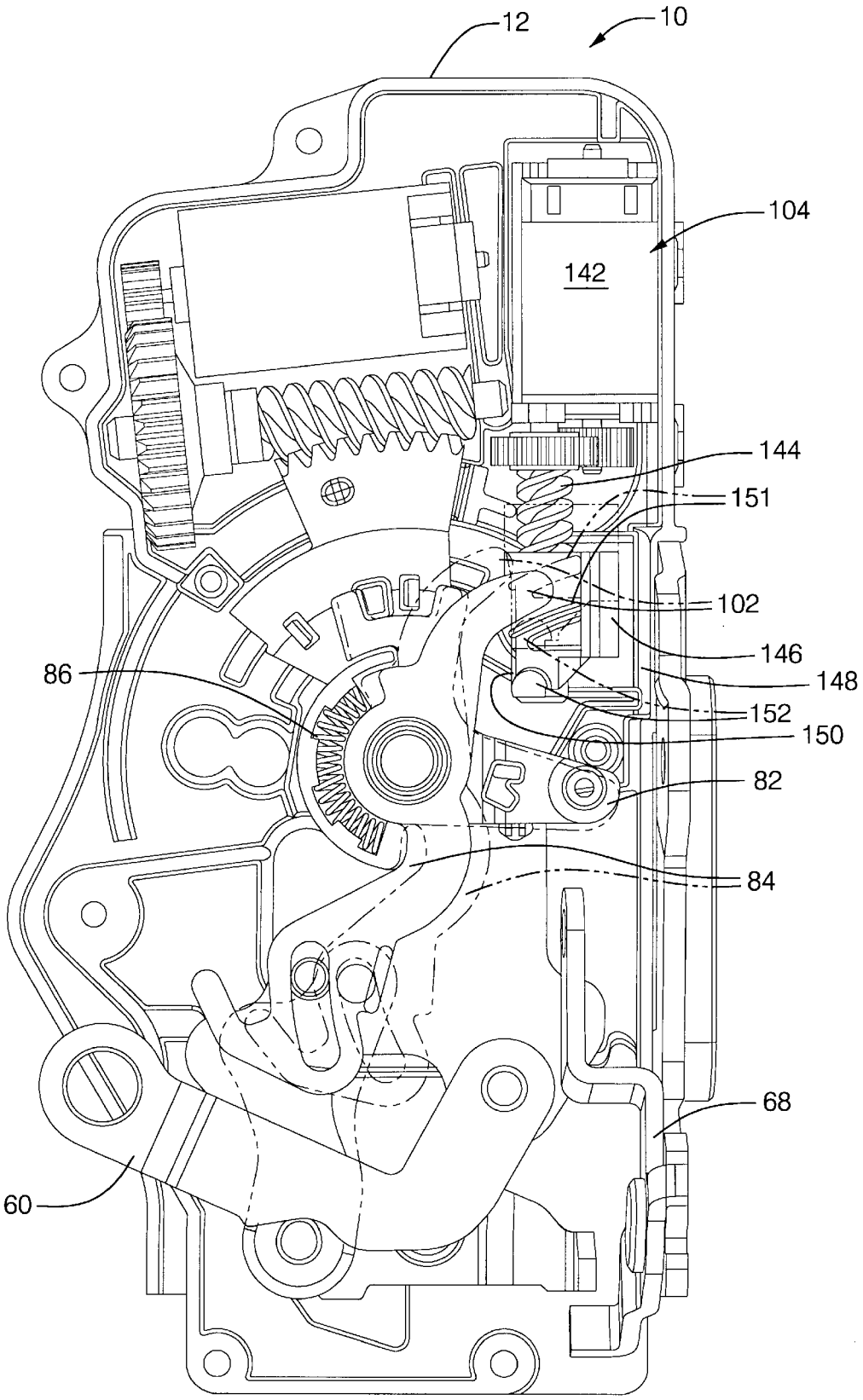
FIG. 11 is a partial rear view of the door latch of FIG. 7 showing the parts in position in dashed line when an unlocking operation has been initiated by an outside key lock cylinder or the like and in solid line when the unlocking operation has been completed by an upper lock lever.

The second way to disengage double lock 104 is by a key entry by using a key lock cylinder (not shown) to rotate key cylinder lever 106 clockwise from the locked position shown in dashed line in FIG. 10 to the unlocked position shown in solid line. As key cylinder lever 106 rotates clockwise to the unlocked position, ear 109 engages drive pin 152 and pushes lock block 146 down to an intermediate position where ear 102 of upper lock lever 84 "turns the corner" moving from stop wall 150 to ramp wall 151 as shown in solid line in FIG. 10 (and in dashed line in FIG. 11 where key cylinder lever 106 has been removed for clarity). Slot 108 of key cylinder lever 106 simultaneously engages drive lug 110 and rotates lower lock lever 82 clockwise to the unlock position storing energy in compression spring 86. Upper lock lever 84 now takes over and returns to the unlocked position under the bias of compression spring 86 with ear 102 driving lock block 146 down to the disengaged position via ramp wall 151. This second way permits authorized key entry (or exit) when the door latch 10 is double locked and also provides entry or exit in the event of power failure.

Many modifications and variations of the present invention in light of the above teachings may be made. It is, therefore, to be understood that, within the scope of the appended claims, the invention may be practiced otherwise than as specifically described.

What is claimed is:

1. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever being connected to the detent by a first pin and slot arrangement and a lock lever forming part of the lock mechanism, the lock lever moving the intermittent lever back and forth between an unlock position where the intermittent lever drives the detent to release the forkbolt and a lock position where the intermittent lever moves without driving the detent, the slot having a first portion with a stop shoulder and a second elongated portion.

2. The vehicle door latch according to claim 1 wherein the intermittent lever is connected to the lock lever by a second pin and slot arrangement.

3. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever being connected to the detent by a first pin and slot arrangement and a lock lever forming part of the lock mechanism, the lock lever moving the intermittent lever back and forth between an unlock position where the intermittent lever drives the detent to release the forkbolt and a lock position where the intermittent lever moves without driving the detent wherein the first pin and slot arrangement comprises an integral pin of the detent wherein the slot is an integral part of the intermittent lever wherein the slot has a first portion with a stop shoulder and a second elongated portion, and wherein the pin is disposed in the second elongated portion when the intermittent lever is in the lock position.

4. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, the intermittent lever being connected to the detent by a first pin and slot arrangement and a lock lever forming part of the lock mechanism, the lock lever moving the intermittent lever back and forth between an unlock position where the intermittent lever drives the detent to release the forkbolt and a lock position where the intermittent lever moves without driving the detent wherein the intermittent lever is pivotally connected to an unlatching lever of the release mechanism.

5. The vehicle door latch according to claim 4 wherein the release mechanism includes an inside release lever for operating the unlatching lever.

6. The vehicle door latch according to claim 4 wherein the release mechanism includes an outside release lever for operating the intermittent lever.

7. The vehicle door latch according to claim 4 wherein the unlatching lever pivots in a first stud and lock lever pivots on a second stud.

8. The vehicle door latch according to claim 7 wherein the lock lever includes a lower lock lever and an upper lock lever that pivot on the second stud and a spring for storing energy when the lower lock lever pivots with respect to the upper lock lever.

9. The vehicle door latch according to claim 8 wherein the lock mechanism includes an inside lock lever and an outside lock lever for operating the lower lock lever.

10. The vehicle door latch according to claim 9 wherein the outside lock lever pivots on the second stud.

11. A vehicle door latch having a forkbolt that moves between a latched position and an unlatched position, a detent for holding the forkbolt in the latched position, a release mechanism for moving the detent to release the forkbolt and a lock mechanism for disabling the release mechanism comprising:

an unlatching lever that forms part of the release mechanism and that pivots on a stud, an intermittent lever that forms part of the release mechanism and part of the lock mechanism and that is connected to the detent for moving the detent to release the detent, the intermittent lever being pivotally connected to the unlatching lever, and a lock lever that forms part of the lock mechanism, the lock lever moving the intermittent lever back and forth between an unlock position where the intermittent lever drives the detent to release the forkbolt and a lock position where the intermittent lever moves without driving the detent.

12. The vehicle door latch according to claim 11 wherein the intermittent lever is connected to the lock lever by a pin and slot arrangement.

13. The vehicle door latch according to claim 12 wherein the lock lever pivots on a second stud.

14. The vehicle door latch according to claim 13 wherein the lock lever includes a lower lock lever and an upper lock lever that pivot on the second stud and a spring for storing energy when the lower lock pivots with respect to the upper lock lever.

15. The vehicle door latch according to claim 11 wherein the intermittent lever is connected to the detent by a pin that engages in a slot of the intermittent lever, the slot has a first portion that includes a drive shoulder that is engaged by the pin when the intermittent lever is in the unlock position and the slot has a second elongated portion that is engaged by the pin when the intermittent lever is in the locked position.

16. A vehicle door latch having a forkbolt that moves between a latched position and an unlatched position, a moveable detent for holding the folkbolt in the latched position, a release mechanism for moving the detent to release the forkbolt and a lock mechanism for disabling the release mechanism comprising:

intermittent lever for moving the detent to release the forkbolt forming part of the release mechanism and part of the lock mechanism, a composite lock lever forming part of the lock mechanism, the composite lock lever moving the intermittent lever back and forth between an unlock position where the intermittent lever drives the detent to release the forkbolt and a lock position where the intermittent lever moves without driving the detent, and the composite lock lever having a lower lock lever and an upper lock lever that pivot on a stud and a spring that stores energy biasing the upper lock lever toward an unlocked position when the lower lock lever pivots to an unlocked position while the upper lock lever is held in a locked position.

17. A vehicle door latch having a forkbolt that moves between a latched position and an unlatched position, a moveable detent for holding the folkbolt in the latched position, a release mechanism for moving the detent to release the forkbolt and a lock mechanism for disabling the release mechanism comprising:

an intermittent lever for moving the detent to release the forkbolt forming part of the release mechanism and part of the lock mechanism, a composite lock lever forming part of the lock mechanism, the composite lock lever moving the intermittent lever back and forth between an unlock position where the intermittent lever drives the detent to release the forkbolt and a lock position where the intermittent lever moves without driving the detent, and the composite lock lever having a lower lock lever and an upper lock lever that pivot on a stud and a spring for storing energy when the lower lock pivots with respect to the upper lock lever wherein the intermittent lever is pivotally connected to an unlatching lever of the release mechanism that pivots on a second stud.

18. The vehicle door latch according to claim 17 wherein the intermittent lever is connected to the lock lever by a pin and slot arrangement.

19. The vehicle door latch according to claim 18 wherein the intermittent release mechanism includes an inside release lever for operating the unlatching lever and the unlatching lever is connected to the detent by a second pin and slot arrangement.

20. The vehicle door latch according to claim 1 wherein the stop shoulder of the first portion is spaced from each end of the second elongated portion.

* * * * *